US005196260A

United States Patent [19]

Dirschl et al.

[11] Patent Number: 5,196,260

[45] Date of Patent: Mar. 23, 1993

[54] PROCESS FOR THE TREATMENT OF FIBROUS MATERIALS WITH MODIFIED ORGANOPOLYSILOXANES AND THE MATERIALS

[75] Inventors: Franz Dirschl, Munich; Jürgen Uhl, Augsburg; Michael Bernheim, Aystetten, all of Fed. Rep. of Germany

[73] Assignee: Ciba-Geigy Corporation, Ardsley, N.Y.

[21] Appl. No.: 892,387

[22] Filed: May 27, 1992

Related U.S. Application Data

[63] Continuation of Ser. No. 437,402, Nov. 15, 1989, abandoned.

[30] Foreign Application Priority Data

Nov. 19, 1988 [DE] Fed. Rep. of Germany ..... 3839136

[51] Int. Cl.[5] ..... B05D 3/02; B32B 27/12

[52] U.S. Cl. ..... 428/290; 427/389.9; 427/387; 428/447

[58] Field of Search ..... 427/387, 389.9; 428/290, 447

[56] References Cited

U.S. PATENT DOCUMENTS

| | | | |
|---|---|---|---|
| 3,398,017 | 9/1968 | Baurain et al. | 117/123 |
| 3,650,811 | 3/1972 | Nordstrom et al. | 427/44 |
| 3,650,812 | 3/1972 | Nordstrom et al. | 427/44 |
| 3,650,813 | 3/1972 | Nordstrom et al. | 427/44 |
| 4,128,678 | 12/1978 | Hedler et al. | 427/218 |
| 4,153,641 | 5/1979 | Deichert et al. | 260/827 |
| 4,189,546 | 2/1980 | Deichert et al. | 528/26 |
| 4,208,506 | 6/1980 | Deichert et al. | 528/32 |
| 4,419,215 | 12/1983 | Voetter et al. | 427/387 |
| 4,421,782 | 12/1983 | Marwitz et al. | 427/54 |
| 4,433,007 | 2/1984 | Marwitz et al. | 427/54.1 |
| 4,463,127 | 7/1984 | Alberts et al. | 524/731 |
| 4,469,840 | 9/1984 | Alberts et al. | 524/50 |
| 4,559,056 | 12/1985 | Leigh et al. | 8/118.64 |
| 4,690,986 | 9/1987 | Sasaki et al. | 525/479 |
| 4,748,215 | 5/1988 | Lindner et al. | 525/479 |
| 4,791,029 | 12/1988 | Fau et al. | 427/387 |

FOREIGN PATENT DOCUMENTS

| | | |
|---|---|---|
| 0166900 | 1/1986 | European Pat. Off. . |
| 0350240 | 1/1990 | European Pat. Off. . |
| 3617267 | 11/1987 | Fed. Rep. of Germany . |
| 60-38816 | 4/1985 | Japan . |
| 1500431 | 1/1975 | United Kingdom . |
| 1389873 | 4/1975 | United Kingdom . |

OTHER PUBLICATIONS

Chem. Abstract 108(14):113174b.

CPI Profile Booklet 1985, Ref. 85-156361/26 of JP 85/088040.

*Primary Examiner*—Janyce Bell

*Attorney, Agent, or Firm*—Marla J. Mathias; Edward McC. Roberts

[57] ABSTRACT

The present invention relates to a process for the treatment of fibrous materials with modified organopolysiloxanes, wherein, in an aqueous medium, an organopolysiloxane copolymer prepared in a first stage from customary cyclic siloxanes (A) and unsaturated silanes (B) in the presence of a crosslinking agent and emulsifier (1) is copolymerized in a second stage with at least one vinyl monomer in the presence of emulsifiers (2), and the resulting dispersion of the modified organopolysiloxane copolymer is applied to the material in the customary manner and the material is dried and subjected to condensation.

The process has the advantage that the materials, in particular textiles, treated by the process, above all coated by the process, have very good waterproof properties and at the same time good to very good water repellency. However, the materials are simultaneously distinguished by a pleasant soft handle, without the degree of whiteness thereof being noticeably impaired.

19 Claims, No Drawings

PROCESS FOR THE TREATMENT OF FIBROUS MATERIALS WITH MODIFIED ORGANOPOLYSILOXANES AND THE MATERIALS

This application is a continuation of application Ser. No. 437,402, filed Nov. 15, 1989, now abandoned.

The present invention relates to a process for the treatment of fibrous materials with modified organopolysiloxanes and the fibrous materials thus treated.

It is known that coating of fibrous materials, in particular textiles, with α,ω-dihydroxydimethylpolysiloxanes gives them a soft handle. It is furthermore known that in the coating of the fibrous materials acrylate copolymers with incorporated crosslinkable groups provide noticeable waterproofing (German Patent Specification 2,616,797). Attempts have also already been made to combine both effects by combination of the polysiloxanes with the crosslinkable copolymers. These attempts have led to only limited success, since the waterproofing still leaves a great deal to be desired, and above all the degree of whiteness of the treated materials in no way meets current requirements.

The present invention was thus based on discovering a system which eliminates the disadvantages of the prior art and imparts to the treated textiles a particularly soft handle and a good to very good waterproofing, while retaining the degree of whiteness, and with which the effects should also meet increased requirements in respect of resistance to washing and cleaning.

Surprisingly, it has been possible to achieve this object by using certain selected modified organopolysiloxanes for the treatment of the fibrous materials.

The present patent application thus relates to a process for the treatment of fibrous materials with modified organopolysiloxanes as described in more detail in patent claim 1. Certain embodiments of this process are claimed in claims 2 to 13, and the fibrous materials treated with the modified organopolysiloxanes are claimed in patent claim 14.

The modified organopolysiloxane copolymers are prepared in two stages. In the first stage, organopolysiloxane copolymers are obtained from the customary cyclic siloxanes (A) and (meth)acrylate-silanes, vinylsilanes and/or cyclic vinylsiloxanes (B) in the first stage.

The cyclic siloxanes (A) are known. Suitable compounds are hexamethyltricyclosiloxane, octamethyltetracyclosiloxane, decamethylpentacyclosiloxane, dodecamethylhexacyclosiloxane and trimethyltriphenyltricyclosiloxane.

The compounds (B) include various substances. The first which may be mentioned are (meth)acrylate-silanes, and in particular especially those of the formula $$CH_2{=}\underset{\underset{R1}{|}}{C}{-}\overset{\overset{O}{\|}}{C}{-}O(CH_2)_x{-}Si(R)_{3-n}(OR)_n \qquad (I)$$

wherein R1 = H or $CH_3$, x = 2 to 6, R = preferably $C_{1-6}$-alkyl -, or also $C_{2-3}$-alkyl-$C_{1-3}$-alkoxy and n = 1, 2 or 3, in particular 2 or 3, those compounds in which R1 = $CH_3$, R = $C_{1-6}$-alkyl, x has a value of 3 or 4 and n has a value of 2 or 3 in turn being particularly suitable as starting compounds. Examples which may be mentioned of such compounds are: acryloyloxypropyldimethoxymethylsilane, acryloyloxypropyltrimethoxysilane, methacryloyloxypropyldiethoxymethylsilane, methacryloyloxypropyltriethoxysilane, methacryloyloxypropyldimethoxymethylsilane, methacryloyloxypropyltrimethoxysilane and methacryloyloxypropyltris(methoxyethoxy)silane.

The compounds listed are preferred for economic reasons, but it is of course also possible to use other compounds of the formula (1) as starting components.

Vinylsilanes above all are furthermore also suitable for reaction with the cyclic siloxanes (A). These compounds have the formula $$CH_2{=}CH{-}Si(R)_{3-n}(OR)_n \qquad (2)$$

wherein R and n have the same meaning as given above, but R can additionally also be acetoxy. Examples which may be mentioned are vinyltriethoxysilane, vinyltris(2-methoxyethoxy)silane and vinyldimethoxymethylsilane.

Finally, cyclic vinylsiloxanes are possible starting components (B). Tetramethyltetravinylcyclosiloxane above all may be mentioned as an example, for economic reasons, but other known cyclic vinylsiloxanes can also be employed according to the invention without problems.

Octamethyltetracyclosiloxane and compounds of the formula (1) or (2) in which R1 = $CH_3$, R = $C_{1-6}$-alkyl x = 3 or 4 and n = 2 or 3 have proved particularly suitable for the preparation of the organopolysiloxane copolymers of the first stage. However, tetramethyltetravinylcyclosiloxane can also advantageously be employed as the starting component.

The compounds (A) and (B) are reacted with one another in amounts of 85 to 99.99, in particular 90 to 99.8% by weight to 15 to 0.01, in particular 10 to 0.2% by weight, for the preparation of the organopolysiloxane copolymers.

The reaction of this 1st stage is known on principle from German Offenlegungsschrift 3,617,267. Thus, this preparation is as a rule carried out in the presence of a crosslinking agent. Crosslinking agents which can be used here are tetraalkoxysilanes and/or the compounds (B), if n is 3. However, trifunctional crosslinking agents, such as methyltrimethoxysilane or ethyltriethoxysilane, are also suitable. These compounds are used here in amounts of 0.1 to 15% by weight, in particular 0.5 to 10% by weight, based on the sum of (A) and (B).

The emulsifiers (1) are a further constituent during the process of the 1st stage. Alkylbenzenesulfonic acids, such as dodecylbenzenesulfonic acid, are above all employed for this, in amounts of 0.05 to 10% by weight, in particular in amounts of 0.5 to 6% by weight, based on the sum of the compounds (A) and (B). It has proved advantageous here for a mixture of alkylbenzenesulfonic acids and a dispersing auxiliary to be used as the emulsifier (1). Straight-chain and/or branched alcohols having 8 to 20, in particular 12 to 18, C atoms have proved to be suitable such auxiliaries. It is entirely possible for the amount of the dispersing auxiliary in the emulsifier (1) to predominate.

Stage 1 is thus carried out as follows:

The water, advantageously distilled or doubly distilled water, and the emulsifier or emulsifier mixture are first weighed out and a homogeneous solution is prepared by stirring, if appropriate while heating. The compounds (A) and (B) and the crosslinking agent are then slowly added to the previously prepared aqueous solution and a homogeneous mixture is prepared, while stirring at slightly elevated temperature. The pre-emulsion thus prepared is homogenized with the aid of a high pressure emulsifying device. A stable dispersion of the organopolysiloxane copolymer is obtained (concentration about 10 to 45% strength).

In the subsequent 2nd stage, copolymerization is carried out with at least one vinyl monomer. Vinyl monomers which are employed here are the known base monomers, such as vinyl esters, for example vinyl acetate, but above all methacrylic or acrylic acid esters, for example methacrylic or acrylic acid esters of alcohols having 1 to 6C atoms. The alkyl acrylates having 2 to 6C atoms in the alkyl radical are particularly suitable as base monomers. These monomers are employed in the 2nd stage in amounts of at least 50% by weight, in particular 55-90% by weight, based on the total monomer. In addition, possible monomers are acrylo- and methacrylonitrile, acrylamide, styrene, vinyl ethers, methacrylic and acrylic acid esters of alcohols having 8 to 12C atoms, conjugated diolefins, such as, for example, butadiene or isoprene, vinyl chloride, vinylidene chloride, allyl methacrylate and ethylene dimethacrylate. Particularly suitable vinyl monomers here are alkyl acrylates having 2 to 6C atoms in the alkyl radical, acrylonitrile and styrene.

In addition, it has been found that it is particularly advantageous if crosslinkable vinyl monomers are incorporated into the modified organopolysiloxane copolymers. Possible such vinyl monomers here are monomers which contain N-methylol groups, in particular carboxamide methylol groups. Etherified N-methylol groups where alcohols having 1 to 4C atoms, in particular methanol, have been used for the etherification, are suitable reactive groups. As monomers by means of which these groups are introduced into the modified product there may be mentioned, in particular, N-addition products of formaldehyde on methacrylamide or acrylamide, and allyl or methallyl carbamate, the monomethylol compounds in question preferably being copolymerized. In addition, N-methylolacrylamide etherified with methanol, for example, is possible. The crosslinkable monomers are copolymerized here in amounts of at least 0.5% by weight, preferably 1.0 to 10% by weight, based on the total vinyl monomer.

Hydrophilic vinyl monomers are also particularly suitable as the vinyl monomers. Examples of these which may be mentioned are, above all, sodium 2-acrylamido-2-methylpropanesulfonate and/or sodium vinylsulfonate, and also allyl alcohol.

The reaction in the 2nd stage is carried out such that the weight ratio of organopolysiloxane copolymer to vinyl monomer is 1:0.5 to 1:4, in particular 1:1 to 1:2.5.

The reaction in the 2nd stage also takes place in the presence of emulsifiers. It is in general already sufficient here for further processing to be carried out with the emulsifier (1). However, it is particularly advantageous additionally to add further emulsifiers during the 2nd stage. The known nonionic emulsifiers, that is to say the customary ethoxylation products of higher fatty alcohols, fatty acids, fatty amines and fatty acid amides or salts thereof with volatile acids, can be employed for this purpose. Examples which may be mentioned of particularly suitable nonionic compounds are: ethoxylated isotridecyl alcohol having on average 10 to 50 ethylene oxide units, 2,6,8-trimethylnonyloxypolyethylene glycol having 10 to 30 ethylene oxide units and ethoxylated N-(stearyl)- or N-(hexadecyl)-trimethylenediamine having 10 ethylene oxide units.

However, a mixture of the emulsifiers (1) and ethoxylated anionic emulsifiers is particularly preferably employed as the emulsifier (2). Such compounds which may be mentioned are sulfonated or sulfated ethoxylated fatty alcohols or alkylphenols, for example nonylphenol ether-sulfate having 5 to 15 ethylene oxide units and sulfated cetyl, stearyl and/or isotridecyl alcohol ethoxylated with 10 to 15 ethylene oxide units.

In addition to the emulsifiers (2), it is appropriate to carry out the reaction in the presence of protective colloids. The protective colloids which can be employed are known to the expert. The compounds known for emulsion polymerization, in particular polyvinyl alcohol, polyacrylic derivatives and particularly preferably polyvinylpyrrolidone, are used, and in particular in amounts of 0.1 to 5% by weight, based on the finished dispersion.

The copolymerization is essentially carried out in a known manner. In general, a procedure is followed in which the component prepared in process stage (1) is initially introduced into a reaction vessel together with any additional emulsifiers and protective colloids and water, and the mixture is brought to a weakly acid to neutral pH. The monomers or the monomer mixture are introduced into a feed vessel and stirred slowly into the reaction vessel. During this procedure, the polymerization takes place at temperatures of about 50° to 75° C., with slow stirring. The reaction is started by addition of the customary polymerization initiators, above all hydrogen peroxide, sodium hydroxymethanesulfinate and tert-butyl hydroperoxide, which are used in the customary manner. During the polymerization, a largely constant pH should be ensured by addition of, for example, sodium carbonate. Thereafter, the polymerization is brought to conclusion by further addition of catalyst and the mixture is then stirred until cold. Process stages 1 and 2 can also advantageously be carried out directly in succession (one-pot process).

20 to 50% strength, in particular 30 to 45% strength, dispersions of the modified organopolysiloxane copolymers are obtained in the manner described. These dispersions can be employed directly for the treatment of fiber materials, in particular by coating, that is to say the coating pastes can in general be prepared in a simple manner, above all without catalysts and stabilizers.

The resulting dispersions are thus employed directly for coating, it merely being necessary for customary thickening agents and foam suppressants also to be used under certain circumstances. Possible thickening agents are the preparations known from textile printing, for example starch and modified starch, vegetable gum and vegetable mucilages, such as tragacanth, alginates and carob bean flour, cellulose derivatives, such as carboxymethylcellulose and hydroxyethylcellulose, and synthetic thickening agents, such as polyacrylic acid. The desired viscosity is established with these thickening agents, for which in general only small amounts, in particular 0.4 to 6% by weight, based on the coating composition, are required. The foam suppressants used are likewise known. Those based on silicones or ethoxylated compounds are preferably used for this purpose.

The coating composition is then applied in a known manner by knife-coating (for example with rollers or above all air and rubber blanket doctor blades), brushing, printing and the like, to the textile goods to be treated. In practice, a continuous process is as a rule used, whereas in the laboratory the coating mass is also, for example, brushed on discontinuously. In the continuous procedure, the goods run at a speed of 5 to 25 m/minute, depending on the material, and immediately after the application are passed through a heating zone and dried here at temperatures of 100° to 190° C., and if appropriate subjected to condensation, the average residence time being between half a minute and 6 minutes. The amount applied is between 5 and 100 g/m$^2$. Lighter materials which are processed for leisure and rainproof clothing or umbrella cloth are given an application of 5 to 20 g/m$^2$. Medium weight materials, such as tarpaulin, sailcloth, tent and marquee fabrics or terrycloth articles are given an application of 20 to 70 g/m$^2$, and heavier materials, such as, in particular, industrial fabrics, are given an application of up to 100 g/m$^2$ (data based on the solid substance), it being advantageous, or even necessary, to apply the desired application amount in two or more passes, which is possible without problems by the process according to the invention, in order to achieve a uniform, coherent film. Most articles are coated on only one side, but the other side can also be provided with a coating in the same manner.

The materials coated on both sides, and in particular those coated on one side, are often after-impregnated. This after-impregnation results in an optimization of the effects, and in addition in the case of coating on only one side, the other side is also provided with a particular water-repellant finish. The after-impregnation is carried out in a known manner using the known treatment agents, such as paraffin emulsions and silicone emulsions containing metal salts, and can also be combined with an oleophobic, anti-rot and/or creaseproof treatment, the known treatment agents likewise being employed. The process technology of the after-impregnation is generally known. In general, the material is padded and then finished by drying and condensation. The additional impregnation can also be carried out before coating.

The coating compositions can also contain other substances suitable for textile treatment, such as, in particular, finishing agents. Aminoplast condensates may be mentioned as examples. Agents for soft handle and flameproofing agents, and if necessary the corresponding catalysts, may also be mentioned.

During the treatment, as a rule 4 to 200 g/l (higher amounts are inappropriate for economic reasons), in particular 5 to 100 g/l, of the 100% pure modified organopolysiloxane copolymers are stirred into water, depending on the liquor pick-up and the desired effect, and the treatment is carried out in the customary manner by dipping and squeezing off (padding), slop padding or spraying. Thereafter, the material is dried and, depending on the material treated, subjected to condensation for a few seconds to minutes at 120° to 190° C.

The treatment liquors can likewise also contain other substances suitable for textile treatment, such as finishing agents. Aminoplast condensates may be mentioned as examples. Agents for soft handle and flameproofing agents, and if necessary the corresponding catalysts, may also be mentioned.

The process according to the invention is suitable for coating and treating all types of fibrous materials, in particular textile fibrous materials, in the form of woven fabrics, knitted fabrics or non-wovens. These can be produced either from naturally occurring fibers, such as cellulose or keratin fibers, or from synthetic fibers, such as polyacrylonitrile, polyamide or polyester. Textile materials which consist of mixtures of naturally occurring and synthetic fibers are of course also possible. It should be emphasized that low set fabrics, such as taffeta and/or low set poplin materials, can also be treated by the process according to the invention. This is of particular importance, for example, for rainproof clothing, such as anoraks or the like.

The modified organopolysiloxane copolymers used according to the invention have the advantage that they can be formulated to give liquors and pastes in a simple manner and above all the pastes can be easily processed because of their minimal tackiness and good stability (pot life about 1 week). The compatibility with other polymers is also virtually unlimited because of the lack of catalysts.

By the process according to the invention, fibrous materials, in particular textile materials, which have outstanding waterproof properties and at the same time a pleasant, soft handle, without the degree of whiteness being noticeably impaired, are obtained by the coating. It is particularly remarkable here that the waterproofing and above all their stability to cleaning is astonishingly high. Moreover, as in the known processes, the other properties of the materials treated, above all the filling effect and the improved crease-proofing, are retained in the process according to the invention. From the prior art, it can in no way be seen that precisely the modified organopolysiloxane copolymers used here would deliver the synergism sought in respect of the level of the effects and the stability of the effects.

Outstanding overall effects can also be achieved in a simple manner, however, in the context of customary treatment.

The degree of whiteness is determined here by a formula developed by GANZ (in this context, compare R. G. Griesser, Textilveredlung 18 (1983), No. 5, pages 157 to 162). The "ELREPHO 2000 Spectrophotometer for reflectance measurements" from DATACOLOR has proved suitable for these investigations.

The waterproofing is determined in accordance with DIN 53886 and the showering in accordance with DIN 53888 (duration 10 minutes).

The invention will now be illustrated in more detail with the aid of the following examples, wherein parts denote parts by weight and percentages denote % by weight.

EXAMPLE 1

Preparation of the modified organopolysiloxane copolymer

Process of the 1st stage 667 g of doubly distilled water, 2.5 g of dodecylbenzenesulfonic acid and 7.5 g of cetyl alcohol are introduced in succession into a 2000 ml glass beaker and the mixture is heated at 60° C., while stirring, until all the components have dissolved. The mixture is then subsequently stirred for a further 5 minutes to bring the process to completion.

Alongside, 2.5 g of tetraethylorthosilicate, 1.95 g of methacryloyloxypropyltriethoxys and 249 g of octamethyltetracyclosiloxane are weighed into a 400 ml glass beaker and the mixture is poured slowly into the mixture in the 2000 ml glass beaker. The mixture is now stirred at 60° C. for a further 10 minutes.

The resulting mixture is subsequently homogenized under 250 bar at 55° C. on a high pressure homogenizing machine.

The resulting emulsion is then introduced into a 1 liter four-necked flask provided with a contact thermometer, reflux condenser, stirrer and nitrogen inlet tube and the polymerization is brought to completion in the course of 3 hours at 95° C. under nitrogen. The resulting organopolysiloxane copolymer dispersion has a dry substance content of about 22%.

Process of the 2nd stage 645 g of the dispersion prepared in stage 1, 16.8 g of an ethoxylated sodium nonylphenol sulfate having on average 8 ethylene oxide units per molecule, 38.3 g of a 10% strength solution of polyvinylpyrrolidone, 4.6 g of doubly distilled water, 1.1 g of sodium 2-acrylamido-2-methylpropane-sulfonate and 5.5 g of a 10% strength sodium carbonate solution are introduced into a polymerization vessel at intervals of about 3 minutes and the components are stirred together for one hour at a speed of 250 revolutions per minute.

Alongside, in a feed container, 211.3 g of butyl acrylate (stabilized), 1.7 g of ethoxylated isotridecyl alcohol having 40 ethylene oxide units per mole are heated at 40° C. until a clear solution is obtained, and 51.5 g of acrylonitrile, while cooling to 25° C., and 16.6 g of N-butoxymethylmethacrylamide are then added (pH about 5).

For polymerization, the mixture in the feed vessel is pumped into the polymerization vessel in the course of 15 minutes (stirrer speed 200 revolutions per minute), the temperature is brought to 64° C. and the polymerization is carried out as follows:

4 ml of 30% strength hydrogen peroxide are first added, the mixture is stirred for 2 minutes and addition of 8680 microliters of a 10% strength solution of sodium hydroxymethanesulfinate is started (metering rate 104 microliters per minute), during which the temperature is kept constant between 63° and 67° C. After 60 minutes, 0.5 ml of 10% strength sodium carbonate solution is introduced, and after 135 minutes the main reaction has ended. 0.5 ml of 85% strength t-butyl hydroperoxide, and after 150 minutes a further 2 ml of the 10% strength solution of sodium hydroxymethanesulfinate, are now added, stirring is continued for 15 minutes, without heating, and the mixture is then cooled to 25° C. The resulting dispersion has a dry substance content of 42.3% and a pH of 4 to 5.

For coating, a white polyamide taffeta (about 70 g/m$^2$) is treated as follows:

1000 g of the dispersion, prepared as described above, of the modified organopolysiloxane copolymer are mixed with 30 g of a commercially available thickener based on polyacrylic acid (diluted 1:1 with distilled water) and 3 ml of a commercially available nonionic foam suppressant, and 1 ml of 25% strength ammonia is slowly added dropwise, while stirring. The coating composition is in this way brought to a viscosity of 13000 mPa.s (product A according to the invention).

For comparison with the prior art, a product B is prepared as follows:

1000 g of the copolymer dispersion described in Example 1 of German Patent Specification 2,616,797 are mixed with 10 g of a compound having the formula $H_2N(CH_2)_2NH(CH_2)_3Si(OC_2H_5)_3$, 20 g of dibutyl-tin dilaurate and 20 g of 60% strength acetic acid to give a coating composition.

For further comparison with the prior art, a product C is prepared as follows:

600 g of the copolymer dispersion described in Example 1 of German Patent Specification 2,616,797 and 400 g of a commercially available approximately 60% strength dispersion of an $\alpha,\omega$-dihydroxydimethylpolysiloxane (viscosity of the silicone about 80000 mPa.s at 20° C.) are mixed with the components mentioned under product B to give a coating composition.

The polyamide taffeta is coated in one stroke with 8 g/m$^2$ (based on the solid substance) using the products A to C thus prepared, and is finally dried, after-impregnated with an aqueous liquor of 60 g/l of ®Scotchgard FC 270 (3M company) and 10 g/l of a commercially available approximately 60% strength extender based on a fat-modified synthetic resin, dried again briefly and subjected to condensation at 150° C. for 2–3 minutes.

The results of the resulting treatment—after lying out in a normal climate—are summarized in the following table:

| Product | Degree of whiteness according to GANZ: Decrease in degree of whiteness | Degree of whiteness | Waterproofing (water column in mm): Original | 5 × 40° C. mechanical | 3 × chemical cleaning | Handle |
|---|---|---|---|---|---|---|
| A (corresponding to the invention) | +3 | 24 | more than 1000 | 210 | 350 | soft, pleasantly flowing |
| B (corresponding to the prior art) | −20 | 1 | more than 1000 | 190 | 235 | slightly tacky, not very soft |
| C (corresponding to the prior art) | −50 | −29 | 220 | 120 | 180 | soft, paper-like |
| untreated | — | 21 | — | — | — | |

Considering also that the product A used according to the invention is easy to prepare and has a long pot life and good compatibility with other polymers, the overall essentially improved properties of the process according to the invention are illustrated in particular by the above summary, the water repellency also showing good wash-resistant effects here (product A: water uptake 9.3%, beading effect 4/4/3, after 5×40° C. machine washes water uptake 10.8%, beading effect 3/3/2).

EXAMPLE 2

Example 1 is repeated in the manner described, except that, instead of the methacryloyloxypropyltriethoxysilane mentioned there, 7.45 g of vinyltributoxysilane and, instead of the cetyl alcohol, the same amount of lauryl alcohol are used for the reaction in the 1st stage.

If the same material is coated in the same manner with the product thus obtained, similar treatment results are obtained.

EXAMPLE 3

The following monomers are copolymerized in the manner described in Example 1, building up on the organopolysiloxane copolymer of stage 1 of Example 1 in the manner described in Example 1, stage 2:

147 g of butyl acrylate,
98 g of vinyl acetate,
17 g of styrene and
12 g of N-methoxymethylacrylamide.

If a polyester/cotton poplin (67:33, about 110 g/m$^2$) or a pure cotton poplin (120 g/m$^2$) is coated in one stroke (amount applied 10 or 12 g/m$^2$) with the dispersion thus prepared, which has been adjusted to a dry substance content of about 45% by weight, and is after-impregnated and finished as described in Example 1, a good degree of whiteness, a good waterproofing which is stable to washing and cleaning, and above all a pleasantly soft handle is obtained.

EXAMPLE 4

Stage 2 is carried out as follows, in the manner described in Example 1 and building up on the organopolysiloxane copolymer of stage 1 of Example 1:

645 g of the dispersion prepared in stage 1, 11.2 g of the ethoxylated sodium nonylphenol sulfate mentioned therein,
2.55 g of the 10% strength solution of polyvinylpyrrolidone,
169 g of doubly distilled water, 0.55 g of sodium 2-acrylamido-2-methylpropanesulfonate and
b 5.9 g of a 10% strength sodium carbonate solution are introduced into the polymerization vessel at intervals of about 3 minutes and the components are stirred together for 1 hour at a speed of 250 revolutions/minute.

Alongside, 105.4 g of stabilized butyl acrylate and 1.1 g of the ethoxylated isotridecyl alcohol mentioned are heated at 40° C. in a feed container, until a clear solution is obtained, and 25.7 g of acrylonitrile, while cooling to 25° C., and 8.3 g of N-butoxymethylmethacrylamide are then added (pH about 5.2).

The polymerization is carried out as described in Example 1. A stable dispersion of 30% by weight is obtained.

A cotton poplin (about 120 g/m$^2$) is treated as follows with the dispersion thus prepared:

A liquor is prepared from 30 g/l of a 70% strength aqueous solution of a cellulose crosslinking agent (mixture of dimethyloldihydroxyethyleneurea and methanol-etherified pentamethylolmelamine 6:1 containing about 4% of neutral salt),
9 g/l of an approximately 35% strength weakly acid zinc nitrate solution,
2 ml/l of 60% strength acetic acid,
300 g/l of the 30% strength dispersion prepared as above and
5 g/l of ethyleneurea, and the cotton poplin is padded with this liquor (liquor pick-up about 92%), dried at 110° C. for 10 minutes, subsequently calendered at 140° C. and then subjected to after-condensation at 150° C. for 5 minutes.

The fabric treated in this manner has a very good, stable water-repellency and a pleasantly soft, full silicone handle, without the degree of whiteness being noticeably impaired.

EXAMPLE 5

The following monomers are copolymerized in the manner described in Example 1, building up on the organopolysiloxane copolymer of stage 1 of this example in the manner described therein under stage 2:

182 g of butyl acrylate,
99.3 g of ethyl acrylate,
5.1 g of acrylamide,
1.6 g of sodium 2-acrylamido-2-methylpropanesulfonate and
24.3 g of N-butoxymethylmethacrylamide.

If the polyamide taffeta described in Example 1 is coated with the dispersion thus prepared, which has been adjusted to a dry substance content of about 43.5% by weight, similarly good results to those stated therein are achieved.

EXAMPLE 6

A commercially available release paper is coated with the following composition:

200 g of the product A according to the invention mentioned in Example 1,
2 g of a commercially available thickener based on polyacrylic acid (diluted 1:1 with distilled water),
0.5 g of a commercially available foam suppressant (®RESPUMIT SI from Bayer) and
5 ml/l of a 10% strength ammonia.

The amount applied (based on the dry substance) is 5 g/m$^2$. The coated paper is then dried at 90° C. for 10 minutes and subjected to condensation at 120° C. for 15 minutes. The paper provided with a soft, water-repellant and waterproof film in this manner is outstandingly suitable as a release paper.

We claim:

1. A process for waterproofing fibrous material which comprises applying an aqueous dispersion of a modified organopolysiloxane to the fibrous material, then drying the fibrous material, and then subjecting the fibrous material to condensation, said aqueous dispersion being obtainable by a process which comprises:

(1) preparing an organopolysiloxane copolymer by reacting a compound (A) with a compound (B) in an aqueous medium and in the presence of a crosslinking agent and a first emulsifier, the compound (A) being a cyclic siloxane and the compound (B) being a (meth)acrylate-silane, a vinyl-silane or a cyclic vinylsiloxane, or a mixture thereof; and
(2) copolymerizing the organopolysiloxane copolymer with a vinyl monomer at a ratio of organopolysiloxane copolymer to vinyl monomer of 1:0.5 to 1:4, the copolymerization being carried out in the aqueous medium of step (1), without isolation of the organopolysiloxane copolymer, in the presence of a second emulsifier, said first and second emulsifiers being the same or different.

2. The process as claimed in claim 1, wherein the organopolysiloxane copolymer has been prepared by reaction of 90 to 99.8% by weight of compound (A) with 10 to 0.2% by weight of compound (B).

3. The process as claimed in claim 2, wherein the preparation of the organopolysiloxane copolymer is carried out in the presence of 0.1 to 15% by weight of crosslinking agent, based on the sum of (A) and (B).

4. The process as claimed in claim 3, wherein the compound (B) has simultaneously been employed as the crosslinking agent.

5. The process as claimed in claim 1, wherein a mixture of an anionic sulfonic acid and a dispersing auxiliary has been used as the first emulsifier.

6. The process as claimed in claim 5, wherein an alcohol having 8 to 20C atoms has been used as the dispersing auxiliary.

7. The process as claimed in claim 1, wherein octamethyltetracyclosiloxane has been used as the compound (A).

8. The process as claimed in claim 1, wherein the preparation of the organopolysiloxane copolymer and the subsequent copolymerization of the vinyl monomer or monomers have been carried out in a one-pot process.

9. The process as claimed in claim 1, wherein the aqueous dispersion of a modified organopolysiloxane is applied in amounts of at least 5 g/m$^2$, to the fibrous materials by coating in the customary manner.

10. A fibrous material treated by a process of claim 1.

11. A process of claim 2 wherein compound (B) is a compound of the formula

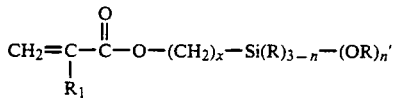

or of the formula $CH_2{=}CH{-}Si(R)_{3-n}(OR)_n$ wherein $R_1$ is $CH_3$, R is $C_1$–$C_6$-alkyl or $C_2$–$C_3$-alkyl-$C_1$–$C_3$-alkoxy-, x is 3 or 4 and n is 2 or 3.

12. A process of claim 3 the weight of the cross-linking agent is from 0.5 to 10% based on the sum of (A) and (B).

13. A process of claim 1 wherein the weight ratio of organopolysiloxane copolymer to vinyl monomer is 1:1 to 1:2.5.

14. A process of claim 18 wherein the hydrophilic vinyl monomer is sodium 2-acrylamido-2-methylpropanesulfonate or sodium vinylsulfonate.

15. A process of claim 9 wherein the aqueous dispersion is applied at a rate of from 5 to 70 g/m$^2$.

16. A process of claim 9 wherein the aqueous dispersion is applied at a rate of from 5 to 20 g/m$^2$.

17. A process of claim 1 wherein the vinyl monomer is selected from the group consisting of alkyl acrylates having 2 to 6 carbon atoms in the alkyl radical, acrylonitrile and styrene.

18. A process of claim 1 wherein the vinyl monomer is a hydrophilic vinyl monomer.

19. A process of claim 1 wherein the copolymerization is carried out at a weakly acidic to neutral pH and the second emulsifier consists of a nonionic emulsifier or a ethoxylated anionic emulsifier and a protective colloid.

* * * * *